US010566154B2

(12) United States Patent
Koepsell

(10) Patent No.: US 10,566,154 B2
(45) Date of Patent: Feb. 18, 2020

(54) ELECTRIC ROCKER SWITCH

(71) Applicant: Johnson Electric International AG, Murten (CH)

(72) Inventor: Martin Koepsell, Ennepetal (DE)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 0 days.

(21) Appl. No.: 16/041,863

(22) Filed: Jul. 23, 2018

(65) Prior Publication Data

US 2018/0342362 A1 Nov. 29, 2018

Related U.S. Application Data

(63) Continuation of application No. PCT/CN2017/071278, filed on Jan. 16, 2017.

(30) Foreign Application Priority Data

Jan. 21, 2016 (DE) ..... 10 2016 101 017

(51) Int. Cl.
*H01H 23/14* (2006.01)
*H01H 1/26* (2006.01)
(Continued)

(52) U.S. Cl.
CPC ..... *H01H 23/14* (2013.01); *H01H 1/26* (2013.01); *H01H 3/60* (2013.01); *H01H 23/04* (2013.01); *H01H 23/20* (2013.01)

(58) Field of Classification Search
CPC ..... H01H 23/14; H01H 1/26; H01H 3/60; H01H 23/16; H01H 23/20; H01H 23/04; H01H 23/02
(Continued)

(56) References Cited

U.S. PATENT DOCUMENTS 1,694,569 A 12/1928 Walsh
5,117,077 A * 5/1992 Sakurada ..... H01H 13/48 200/301
5,473,130 A * 12/1995 Pudims ..... H01H 23/30 200/559

FOREIGN PATENT DOCUMENTS

DE 588594 C 11/1933
DE 3208990 A1 9/1983
(Continued)

*Primary Examiner* — Edwin A. Leon
*Assistant Examiner* — Lheiren Mae A Caroc
(74) *Attorney, Agent, or Firm* — Muncy, Geissler, Olds & Lowe, P.C.

(57) ABSTRACT

The invention relates to an electric rocker switch with an actuating element designed as a rocker. The rocker is thereby moveable back and forth between two positions, namely between an on position and an off position. The rocker is pivotably mounted on the housing for this purpose. The rocker interacts with a leaf spring, the upper end of the leaf spring is firmly clamped at the rocker via a longitudinal area and the lower end of the leaf spring is tiltably arranged on a contact element. The leaf spring has one stable arch shape in the on position and another stable arch shape in the off position with a curve oriented opposite the arch shape. The electric rocker switch according to the invention shows in an advantageous way symmetrical haptics for the on position and also for the off position, wherein the position of the rocker indicates the corresponding position.

19 Claims, 2 Drawing Sheets

(51) Int. Cl.

| | |
|---|---|
| ***H01H 3/60*** | (2006.01) |
| *H01H 23/04* | (2006.01) |
| *H01H 23/20* | (2006.01) |

(58) Field of Classification Search
USPC ..... 200/339, 408, 553–563
See application file for complete search history.

(56) References Cited

FOREIGN PATENT DOCUMENTS

| | | | |
|---|---|---|---|
| DE | 3731648 | C1 | 10/1988 |
| DE | 19960207 | A1 | 6/2001 |
| EP | 0232765 | B1 | 4/1992 |

* cited by examiner

ELECTRIC ROCKER SWITCH

CROSS REFERENCE TO RELATED APPLICATIONS

This non-provisional patent application is a continuation application of PCT Application No. PCT/CN2017/071278, filed with the Chinese Patent Office on Jan. 16, 2017, which claims priority to German Patent Application No. 10 2016 101 017.0, filed on Jan. 21, 2016, all of which are incorporated herein by reference in their entirety.

TECHNICAL FIELD

The invention relates to an electric rocker switch with an actuating element designed as a rocker. The rocker is thereby moveable back and forth between two positions, namely between an on position and an off position. The rocker is pivotably mounted on the housing for this purpose.

BACKGROUND

Electric rocker switches are known from the prior art. In generally, a rocker switch with a moveable contact part which is loaded pretensioned in the direction of the one switch position and is held in the other switch position via a magnet is shown. Furthermore, a rocker switch that is moveable between two positions has a controllable actuator that is in operative connection with the rocker. A system made from electromagnets having a coil and rotor is used in the known rocker systems. Corresponding space in the housing must be provided for such systems, which impedes miniaturization. It is additionally disadvantageous in the preceding systems that no symmetrical haptics are realized for on and off switching. Meanwhile, the haptics of the switching process are dependent on the friction at the elastic body. Temperature and lubrication strongly influence the switching feeling.

SUMMARY

It is the object of the present invention to provide a rocker switch for which the haptics of manual operation are symmetrical, i.e., the same haptics are present for switching on as for switching off. Furthermore, the position of the rocker is to indicate the switching state. The switching mechanism is to be simple to construct and is to generate an identical switching feeling regardless of temperature.

The object is implemented with an electric rocker switch. This electric rocker switch comprises a housing with an actuating element, in this case a rocker, which is mounted to be pivotably moveable on the housing between an on position and an off position. This rocker has mounting holes which engage in studs on the housing and with which the rocker is centrally mounted pivotably moveable on the housing. At least two contact elements, provided in the interior of the housing, each protrude out of the housing as electrical connections. A spring element is arranged between the rocker and a contact element, in this case a pretensioned leaf spring that is tiltably mounted. This leaf spring is held with its one end at the rocker by means of a longitudinal area. For improved distinction, this end of the leaf spring is subsequently designated as the upper end. The lower end is tiltably mounted. The upper end of the leaf spring is held in a receptacle in the mounting element of the rocker, namely in a narrow longitudinal receptacle in which the upper end of the leaf spring is securely held. The end of the leaf spring is hereby inserted into the longitudinal receptacle until it protrudes past the area where the pivot axis of the rocker is located. The pivot axis of the rocker consequently runs through the longitudinal area of the leaf spring held by the rocker. If the rocker is now pivoted, for example, from the off position into the on position, then the held longitudinal area of the leaf spring is moved concomitantly during this pivot movement of the rocker, and the pretensioned leaf spring, which has a stable arch shape in the off position and in the on position, is induced to tilt over, i.e., the curve of the arch shape of the leaf spring changes its direction. During renewed actuation of the rocker, by which means this is moved back into the off position again, the leaf spring is moved back into the original stable arch shape using an equally-sized actuating force. Such a rocker switch is thus symmetrically designed. The on or off position is achieved in the same way by equally large actuating force. The on position may hereby be assigned to one rocker position and the off position to the other rocker position. These symmetrical haptics for the two movement directions are achieved by the spring element which may be arched outward, which is symmetrically deformed during the pivot movement of the rocker. The switching feeling is independent of temperature and lubrication, because friction is prevented between the rocker and the switching mechanism.

In one advantageous embodiment, the leaf spring is arranged pretensioned between the rocker and a contact element provided in the housing. The lower end of the leaf spring is thereby tiltably mounted on a contact element; for example, the end face of the lower end of the leaf spring is inserted into an accommodation groove on the contact element. Such an accommodation groove may have, for example, a triangular cross section. In addition, the leaf spring is connected to a contact arm or is designed as one piece with this contact arm. This contact arm is arranged on the leaf spring such that it interacts with the additional contact element arranged in the housing in the on position and the electric switching circuit is closed in this way.

The leaf spring and the contact arm may, for example, be welded and riveted to one another or the contact arm may be fixed on the leaf spring by a compression connection. It is particularly advantageous if the contact arm is designed to be flexible so that this may better compensate for present tolerances. This may be achieved by a corresponding material selection for the contact arm or by a corresponding geometry of the contact arm. For example, the contact arm may be configured as thinner and thus more flexible than the leaf spring or transverse slits may be provided on the contact arm which make this contact arm more elastic.

In one particular embodiment, the leaf spring has a contact arm which has on its free end a contact piece with a layer designed as a contact surface. This particularly designed contact surface takes into consideration that at higher currents, a sufficient amount of contact material is available as a supply for melting loss.

In one advantageous embodiment of the electric rocker switch, the upper end of the leaf spring, which is accommodated via a longitudinal area in a longitudinal receptacle on the mounting element of the rocker, is additionally tiltably mounted at this upper end on a stationary frame. For this purpose, corresponding projections are provided, for example, on the longitudinal sides of the leaf spring. Such a tilt mounting is arranged, in particular, such that the tilt axis substantially matches the pivot axis of the rocker. For this purpose, the corresponding frame may either be fixed on the housing or, in one advantageous embodiment, be fixed on a printed circuit board provided in the interior of the housing.

Holes for accommodating corresponding connecting means of the frame are preferably provided on the housing or on the printed circuit board for the fixing. Thus, the frame may have on its outer side, for example, laterally protruding studs which enable a plug connection to the housing or to the printed circuit board. A fixing of the frame to the printed circuit board has the advantage that the assembly process is substantially facilitated. Thus, the printed circuit board, the frame, and the leaf spring may be pre-assembled and may be inserted into the housing using a straight-line movement.

In another embodiment, more than two contact elements may also be provided in the housing, for example, for a changeover mechanism (COM). In this case, the first contact element, on which the leaf spring is mounted, is provided centered in the housing between the two additional contact elements, such that the switching process shows a most symmetrical haptics by means of the rocker. The second contact element, which interacts with one contact arm of the leaf spring, is arranged on the one side. The other contact arm is arranged on the opposite side with respect to the curve of the leaf spring and interacts with the third contact element. The leaf spring with its two contact arms is hereby in each case in operative connection with only one contact element in order to initiate a switching process.

The electric rocker switch according to the invention shows in an advantageous way symmetrical haptics for the on position and for the off position, wherein the position of the rocker indicates the corresponding on position or off position. Due to a division of tasks between the leaf spring, the contact arm, and the contact surface on the contact arm, these individual elements may be optimally designed. For example, the spring element is manufactured from a corresponding spring material corresponding to the pretension to be achieved. The contact arm may comprise a less rigid material in order to design it elastically or elastic features are achieved by a corresponding geometry of the contact arm, as previously described. Additional contact material may be welded on the contact surface of the contact arm corresponding to an expected melt loss. Furthermore, due to the arrangement of the contact arm on the leaf spring, it may be ensured that a sufficiently large spacing exists in the off position between the contact surface of the contact arm and the contact surface of the contact element with which the contact arm interacts in the on position. For example, a spacing greater than 3 mm. This is a safety requirement for higher electric currents.

Furthermore, the switching noise during actuation of the rocker, caused by the tilting over of the leaf spring from one stable arch shape into the other, is clearly audible for the user of the rocker switch. If such a switching noise is, however, not desired, the switching noise may also be damped by a corresponding damping film which is applied on the leaf spring.

Easily manufacturable parts, which are assembled in a simple assembly process, are used in an advantageous way for such an electric rocker switch. This leads to a cost-efficient manufacturing of this rocker switch.

BRIEF DESCRIPTION OF THE DRAWINGS

The invention will subsequently be described in greater deal by way of an embodiment.

DETAILED DESCRIPTION OF THE EMBODIMENTS

Figure 1:
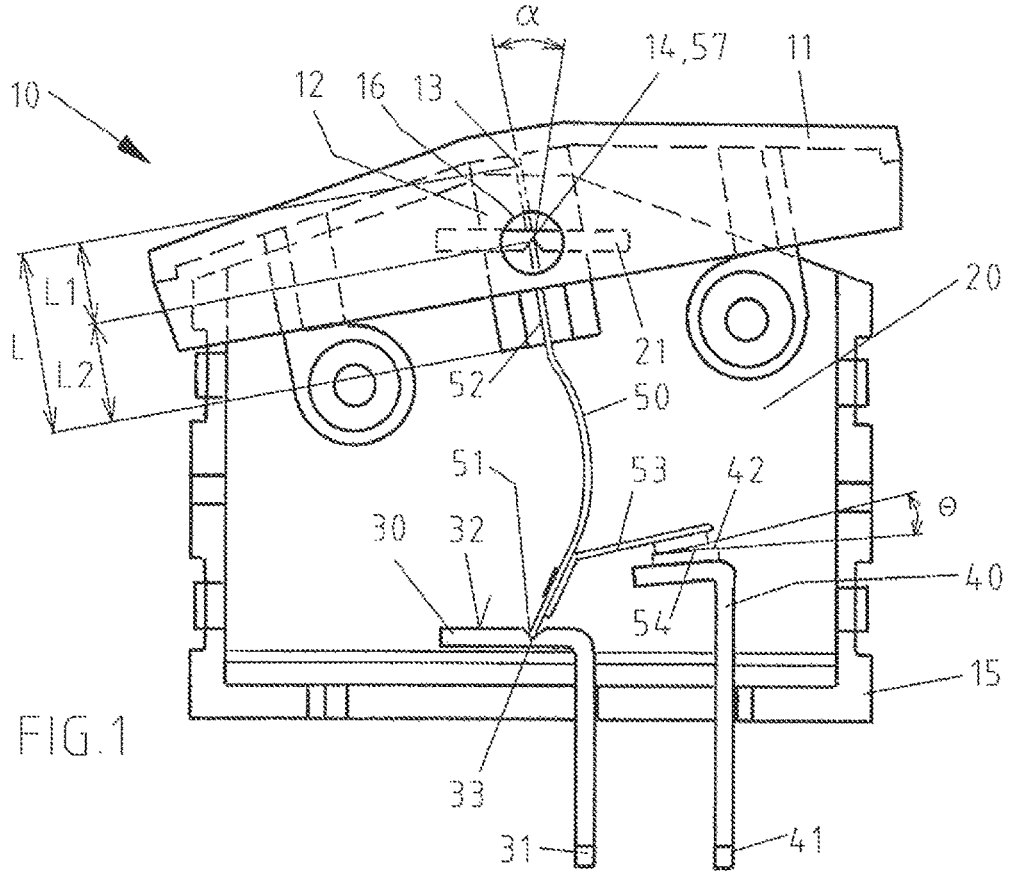
FIG. 1 shows a cross section through an electric rocker switch according to the invention in the on position.

Hereinafter, particular embodiments of the present disclosure are described in detail in conjunction with the drawings, so that technical solutions and other beneficial effects of the present disclosure are apparent. It can be understood that the drawings are provided only for reference and explanation, and are not used to limit the present disclosure. Dimensions shown in the drawings are only for ease of clear description, but are not limited to a proportional relationship.

The electric rocker switch 10 according to the invention shown in FIGS. 1 through 4 comprises, in at least one embodiment, a housing 15 with an actuating element designed as a rocker 11. Two contact elements 30, 40 are provided in the interior of housing 15 and are conducted out of housing 15 as electrical connections 31, 41. A leaf spring 50 is provided between contact element 30 and rocker 11. This pretensioned, arch-shaped leaf spring 50 is tiltably mounted with its lower end 51 in a wedge-shaped accommodation groove 33 of contact element 30 and in this way contacts the contact surface 32 of this contact element 30. The other, upper end 52 of leaf spring 50 is accommodated in a longitudinal receptacle 13 of mounting element 12 of rocker 11, namely via a longitudinal area L. Upper end 52 is hereby inserted into longitudinal receptacle 13 until a longitudinal section L1 protrudes past the pivot axis 14 of rocker 11. Another longitudinal section L2 of upper end 52 of leaf spring 50, held in longitudinal receptacle 13 of mounting element 12 of rocker 11, is located beneath pivot axis 14 of rocker 11. Longitudinal section L1 is then designed to be larger when leaf spring 50 is harder, since a high spring force would lead to upper end 52 of leaf spring 50 breaking free if a correspondingly large longitudinal section L1 is not held above pivot bearing 14 in mounting element 12. The length of longitudinal section L2 is influenced by pivot angle $\alpha$. The greater this longitudinal section L2 is, the smaller the pivot angle $\alpha$ may be which triggers the jump process.

In FIG. 1, rocker switch 10 is shown in its on position. Leaf spring 50 is curved in its center area in an arch shape in the direction toward contact element 40. Leaf spring 50 is connected to a contact arm 53 for contacting contact element 40. This contact arm 53 has a contact part with a contact surface 54 on its bottom side. In this case, a contact material is welded to the bottom side of contact arm 53 for a sufficiently large melting loss. For example, this may be a silver-nickel alloy. In the on position, this contact arm 53 contacts contact surface 42 of contact element 40 using contact surface 54. In order to be able to ensure a sufficient contact pressure and to compensate for tolerances, in at least one embodiment, contact surfaces 42, 54 contacting in the on position are oriented at an acute angle $\theta$ to one another, wherein this angle $\theta$ is preferably greater than 0° and less than 20°.

Figure 3:
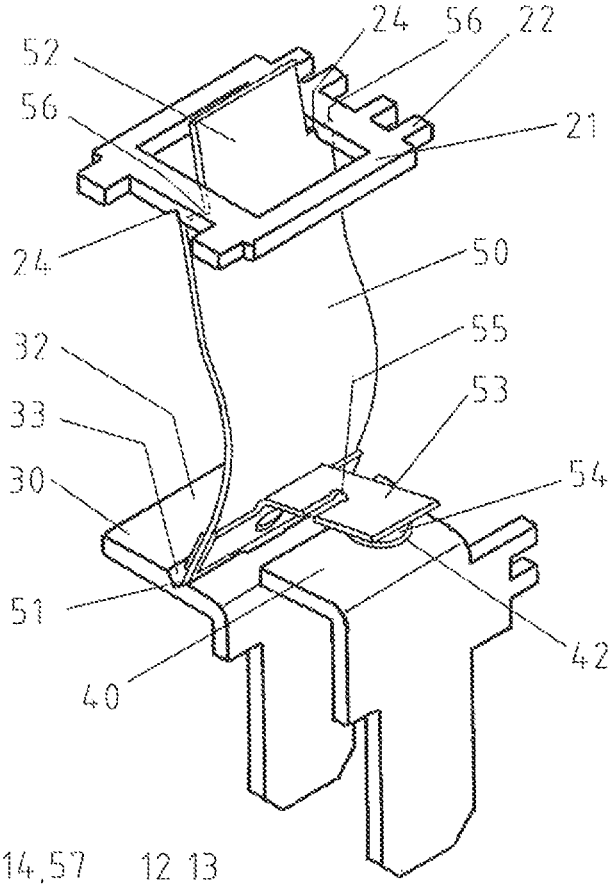
FIG. 3 shows a perspective detail from the rocker switch from FIG. 1.

Pretensioned leaf spring 50 as shown has a sufficient spring force and is produced from a hard spring material, for example, from a bronze material. In this example, contact arm 53 has been connected to leaf spring 50 via a stamping molding process. Contact arm 53 may consequently be made of, in particular, thinner material. This enables leaf spring 50 to be able to accept and compensate for corresponding component tolerances due to elastic contact arm 53. In the case of a contact arm 53, which is designed as one piece engaged with leaf spring 50, elastic properties may also be provided for contact arm 53 through corresponding geometries. For example, contact arm 53, as shown in FIG. 3, may be provided with one or more transverse slits 55.

Figure 4:
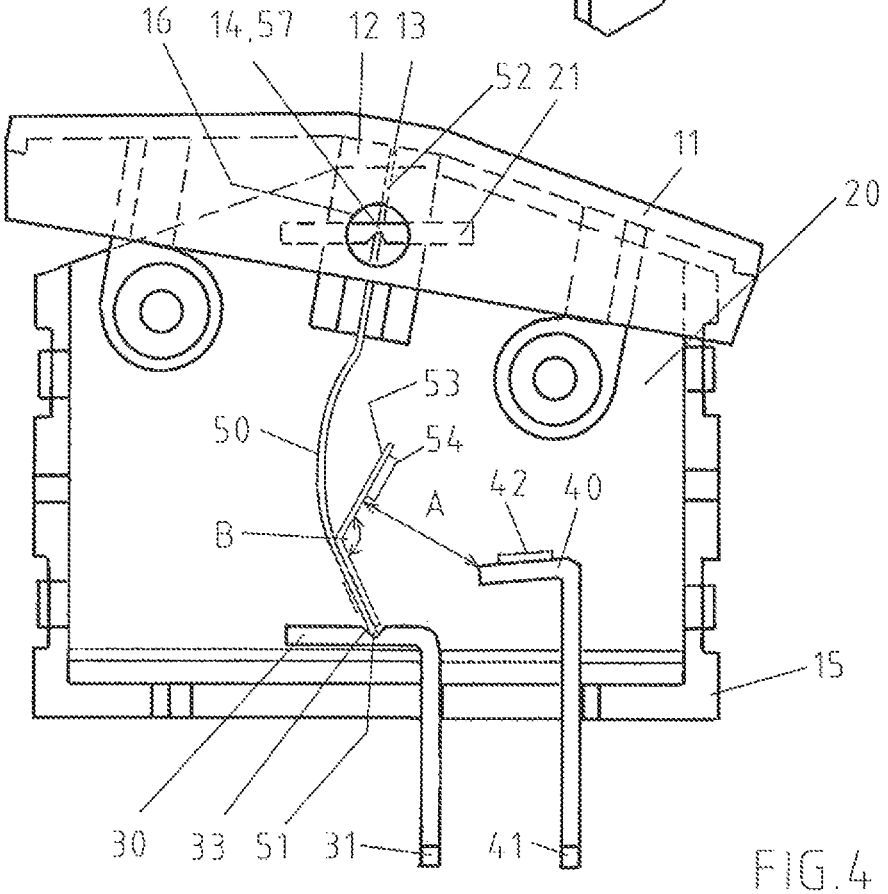
FIG. 4 shows a cross section through the rocker switch from FIG. 1 in the off position.

If rocker switch 10 shown in FIG. 1 is switched into the off position, i.e., rocker 11 is pivoted by the angle α then the off position shown in FIG. 4 is reached. Contact arm 53 and its contact surface 54 are moved away from contact surface 42 of contact element 40. A sufficient spacing A, in at least one embodiment is greater than 3 mm, is provided between contact arm 53 and contact element 40. This is ensured in that contact arm 53 is arranged and fixed on leaf spring 50 such that the contact arm 53 protrudes in an angularly rigid manner at an obtuse angle β away from leaf spring 50 in the direction of contact element 40 in the off position. Leaf spring 50 is also held in mounting element 12 of rocker 11 in this off position and is tilted mounted with lower end 51 in accommodation groove 33 at contact element 30. The arch-shaped curve shown in this case is to the left, i.e., away from contact element 40. During pivoting of rocker 11 by pivot angle α about pivot axis 14, arch-shaped leaf spring 50, whose curve extends from lower end 51 up to mounting element 12 of rocker 11, is initially bent into an S-shape before the pivot movement leads to the curve breaking through into the opposite direction and the switching process is carried out, i.e., contact arm 53 is moved away from contact element 40, or is moved forward onto contact member 40 during pivoting from the off position into the on position.

Figure 2:
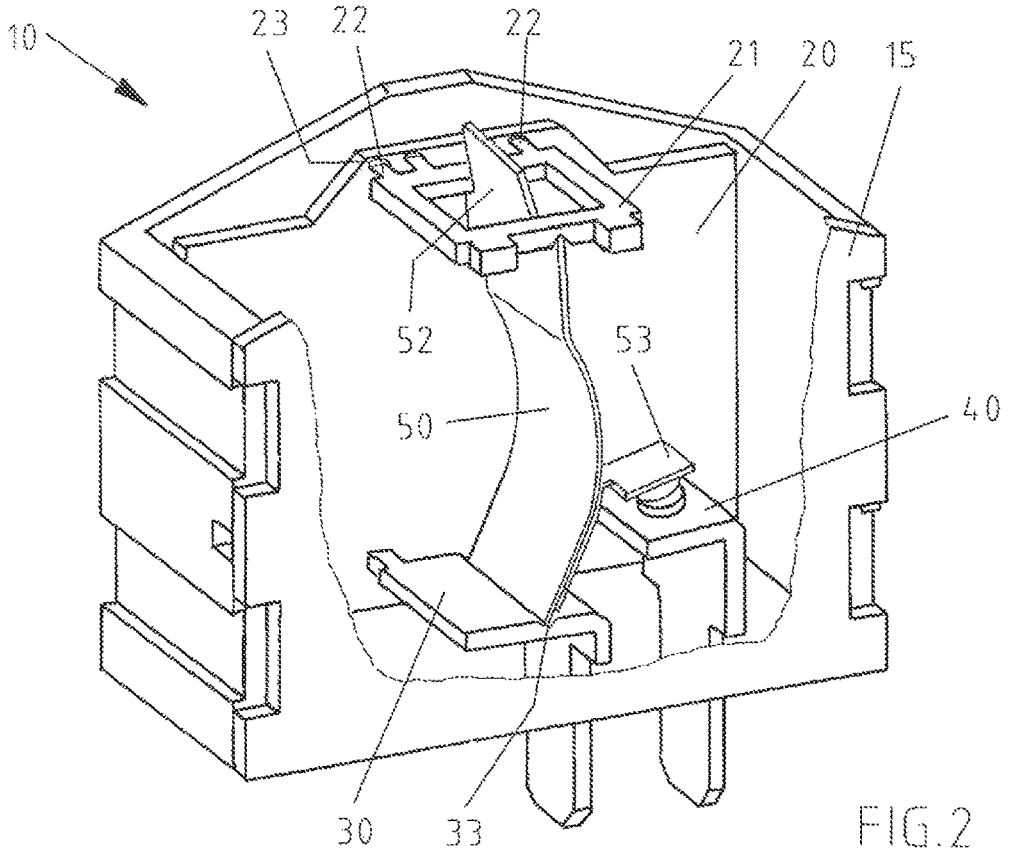
FIG. 2 shows a perspective representation of the rocker switch from FIG. 1.

In an advantageous way, upper end 52 of leaf spring 50 is additionally tiltably mounted in a frame 21. This is more clearly shown in FIGS. 2 and 3. For this purpose, projections 56 are provided on longitudinal area L of leaf spring 50 which is engaged with notches 24 of frame 21 for tiltable mounting. Narrower longitudinal section L1 engages upwardly through frame 21. Frame 21 is positioned stationary in housing 15. In at least example, frame 21 has studs 22 for a plug connection to a printed circuit board 20 arranged in the housing 15. This plug connection is shown in FIG. 2. In addition, frame 21 may also be fixed on housing 11 by corresponding studs 22. In this way, leaf spring 50 is tiltably mounted on its two ends 51, 52, i.e., supported torque free. The tilting axis 57 thereby largely coincides with pivot axis 14 of rocker 11, which is implemented by a corresponding arrangement of frame 21. In addition, upper end 52 of leaf spring 50 is rigidly clamped in mounting element 12 of rocker 11 such that rocker 11 may generate a noticeable switching jump during a pivot movement, namely leaf spring 50 may transfer from a stable state through an S-shaped intermediate state into another stable state. Spacing L2 thereby determines how sensitively the jump of leaf spring 50 follows pivot angle α of rocker 11.

In at least one embodiment, the leaf spring 50 has a noise damping coating, is preferably connected over its surface area by a noise-damping film.

In at least one embodiment, rocker switch comprises two contact elements 30, 40, the lower end 51 of the leaf spring 50 is tiltably mounted on the contact element 30, and the leaf spring 50 comprise one contact arm 53 that interacts with another contact element 40 in the on position.

In other embodiments, the electric rocker switch comprises three contact elements 30, 40, and the leaf spring 50 comprise two contact arms 53 mounted on opposite sides of the leaf spring 50, the two contact arms 53 are interacted with another two contact elements 40 in the on position and the off position respectively. The three contact elements 30, 40 are protruded out of the housing 15 as three electric connections 31, 41.

Contact elements 30, 40 are electrically connected in this example to printed circuit board 20 via a solder connection. In general, additional electronic components are located on printed circuit board 20, like resistors, diodes, microprocessors, LEDs, which are not shown in the figures.

The production and assembly is simplified by present electric rocker switch 10. The preassembled unit shown in FIG. 3 may be mounted in a straight-line movement together with printed circuit board 20. Rocker 11 is subsequently mounted via a snap connection, wherein studs on the housing engage in holes 16 at rocker 11 for pivotable mounting. Mechanical adjustment processes during assembly are avoided.

Due to the large contact distance A between contact surface 54 on contact arm 53 and contact surface 42 on contact element 40 in the off position, such a rocker switch may also replace a safety relay.

The invention claimed is:

1. An electric rocker switch comprising:

a housing (15);

an actuating element configured as a rocker (11) comprising a mounting element (12), the rocker (11) mounted on the housing (15) and movable between an on position and an off position;

at least two contact elements (30, 40) in the interior of the housing (15) and protruding out of the housing (15) as electric connections (31, 41);

a spring element interacted with the rocker (11);

wherein the spring element is a pretensioned leaf spring (50);

wherein an upper end (52) of the leaf spring (50) is clamped at the rocker (11), and the rocker (11) comprises a longitudinal receptacle (13) in the mounting element (12) for accommodating the upper end (52) of the leaf spring (50);

wherein a pivot axis (14) of the rocker (11) is passed through by the upper end (52) of the leaf spring (50);

a wedge-shaped accommodation groove (33) is disposed on one contact element (30) and a lower end (51) of the leaf spring (50) is tiltably mounted in the accommodation groove (33).

2. The rocker switch according to claim 1, wherein the leaf spring (50) has a stable arch shape in the off position and another stable arch shape in the on position with a curve oriented opposite the arch shape.

3. The rocker switch according to claim 1, wherein the leaf spring (50) is connected to a contact arm (53) which interacts with another contact element (40) in the on position.

4. The rocker switch according to claim 3, wherein the contact arm (53) is designed as one piece with the leaf spring (50).

5. The rocker switch according to claim 3, wherein the contact arm (53) comprises a contact piece with a contact surface (54) for contacting the contact element (40) on the free end of the contact arm (53).

6. The rocker switch according to claim 5, wherein in the on position, the contact surface (54) of the contact arm (53) and a contact surface (42) of the contact element (40) are oriented at an acute angle (θ) to one another.

7. The rocker switch according to claim 6, wherein in the on position, the angle (θ) between contact surface (54) of the contact arm (53) and the contact surface (42) of the contact element (40) lies in a range between 0° and 20°.

8. The rocker switch according to claim 3, wherein the contact arm (53) is designed as more elastic than the leaf spring (50) and made from a less rigid material than the leaf spring (50).

9. The rocker switch according to claim 3, wherein the contact arm (53) is designed as more elastic than the leaf spring (50) and made from a thinner material than the leaf spring (50).

10. The rocker switch according to claim 3, wherein the contact arm (53) comprises at least one transverse slit (55).

11. The rocker switch according to claim 3, wherein, in the off position, the contact arm (53) is arranged at an obtuse angle (β) to the lower end (51) of the leaf spring (50).

12. The rocker switch according to claim 1, wherein the upper end (52) of the leaf spring (50) is tiltably mounted on a stationary frame (21) and has projections (56) for this purpose, wherein the tilt axis (c) of the leaf spring (50) matches the pivot axis (14).

13. The rocker switch according to claim 12, wherein a printed circuit board (20) is accommodated in the housing (15) and the frame (21) is fixed on the printed circuit board (20), studs (22) is disposed on an outer side of the frame (21) which engage in holes (23) of the printed circuit board (20).

14. The rocker switch according to claim 1, wherein the leaf spring (50) comprises a noise damping coating, which is connected over the leaf spring (50) surface area by a noise-damping film.

15. The rocker switch according to claim 1, wherein the electric rocker switch comprises three contact elements (30, 40), the leaf spring (50) comprise two contact arms (53) mounted on opposite sides of the leaf spring (50), the two contact arms (53) are interacted with another two contact elements (40) in the on position and the off position respectively.

16. The rocker switch according to claim 15, wherein one of the contact arm (53) is arranged at an obtuse angle (β) to the lower end (51) of the leaf spring (50).

17. The rocker switch according to claim 16, wherein the contact arm (53) comprises a contact surface (54) on the free end of the contact arm (53) for contacting a contact surface (42) of the contact element (40).

18. The rocker switch according to claim 17, wherein the contact surface (54) of the contact arm (53) and the contact surface (42) of the contact element (40) are oriented at an acute angle (θ) to one another, the angle (θ) lies in a range between 0° and 20°.

19. An electric rocker switch comprising:

an actuating element configured as a rocker (11) comprising a mounting element (12), the rocker (11) mounted on a housing (15) and movable between an on position and an off position;

at least two contact elements (30, 40) in the interior of the housing (15) and protruding out of the housing (15) as electric connections (31, 41);

a spring element interacted with the rocker (11);

wherein the spring element is a leaf spring (50);

wherein a wedge-shaped accommodation groove (33) is disposed on one contact element (30) and a lower end (51) of the leaf spring (50) is tiltably mounted in the accommodation groove (33); and wherein the leaf spring (50) has a stable arch shape in the off position and another stable arch shape in the on position with a curve oriented opposite the stable arch shape in the off position.

* * * * *